US006877290B2

(12) United States Patent
Mason

(10) Patent No.: US 6,877,290 B2
(45) Date of Patent: Apr. 12, 2005

(54) BUILDING BLOCK

(75) Inventor: Brett Kerry Mason, Auckland (NZ)

(73) Assignee: Fletcher Building Holdings Limited, Auckland (NZ)

( * ) Notice: Subject to any disclaimer, the term of this patent is extended or adjusted under 35 U.S.C. 154(b) by 0 days.

(21) Appl. No.: 10/383,418

(22) Filed: Mar. 7, 2003

(65) Prior Publication Data

US 2004/0074192 A1 Apr. 22, 2004

Related U.S. Application Data

(63) Continuation-in-part of application No. 09/762,151, filed on Apr. 18, 2001, now abandoned.

(51) Int. Cl.[7] ..... E04C 1/00

(52) U.S. Cl. ..... 52/603; 52/604; 52/606; 52/608; 52/596; 405/284

(58) Field of Search ..... 52/604–606, 608, 52/612, 598, 603, 609; 405/286, 262, 284; 428/409, 34.1

(56) References Cited

U.S. PATENT DOCUMENTS

| | | | | |
|---|---|---|---|---|
| 4,802,320 A | | 2/1989 | Forsberg | |
| 4,932,812 A | * | 6/1990 | Schaaf | 405/284 |
| 5,161,918 A | | 11/1992 | Hodel | |
| 5,294,216 A | | 3/1994 | Sievert | |
| D363,787 S | | 10/1995 | Powell | |
| 5,535,568 A | | 7/1996 | Quinn | |
| D380,560 S | | 7/1997 | Forsberg | |
| 5,776,243 A | * | 7/1998 | Goodson et al. | 106/677 |
| 5,826,650 A | * | 10/1998 | Keller et al. | 165/236 |
| 5,865,006 A | | 2/1999 | Dawson | |
| D430,680 S | | 9/2000 | Blomquist et al. | |
| 6,149,352 A | | 11/2000 | MacDonald | |
| 6,168,351 B1 | | 1/2001 | Rainey | |

FOREIGN PATENT DOCUMENTS

| | | |
|---|---|---|
| AU | 70291/96 | 5/1997 |
| NZ | 330302 | 9/1998 |

* cited by examiner

*Primary Examiner*—Naoko Slack
*Assistant Examiner*—Jennifer I. Thissell
(74) *Attorney, Agent, or Firm*—Arnold & Ferrera, LLP

(57) ABSTRACT

A plurality of building blocks (1) form a retaining wall (300), which may be curved, with respective side edges (6, 7) providing pivot points and a stepped base (5) of an upper block (1) being positionable on the upper surface (4) of a lower block (1). The gaps between the blocks 1, and their permeability, being made from permeable concrete, can avoid hydrostatic build up behind the wall (300). The permeability of the concrete used for the blocks (1) is in the range of $10^{-2}$ m/s to $10^{-4}$ m/s and may be in the region of $6.00\times10^{-3}$ m/s.

10 Claims, 8 Drawing Sheets

BUILDING BLOCK

CROSS-REFERENCE TO RELATED APPLICATIONS

This application is a Continuation-in-Part of U.S. application Ser. No. 09/762,151, filed Apr. 18, 2001 now abandoned, to which application priority it claimed.

TECHNICAL FIELD

This invention relates to a building block and particularly, but not exclusively to a building block for use in constructing a retaining or coastal protection wall.

BACKGROUND OF THE INVENTION

Retaining walls and coastal protection walls are required to sustain all weather conditions and large stresses over long periods. It is also a requirement in many instances that the wall retain an attractive appearance or at the least not be a prominent defacement to the surrounding environment.

Timber has been used for constructing retaining walls. However, timber has the disadvantages of splintering and decaying over time. Furthermore, timber walls typically require the use of chemical preservatives like creosote, nickel or arsenic which are potentially hazardous both to the environment and the handlers of these chemicals. Quality timber is in high demand world-wide and supply is limited and therefore alternative materials are sought which can give an economic and environmental advantage over timber.

Cast-in-place concrete and conventional mortared masonry walls have also been used for constructing retaining walls. These are inflexible and are susceptible to stresses created by movement and settlement of the material being retained and foundations of the wall. Furthermore, water may be trapped behind walls of this type, resulting in the development of hydrostatic pressure behind the wall. This pressure may place further strain on the wall, perhaps shortening its life span. Furthermore, walls of this type may be unattractive in many surroundings as they do not readily allow plants to grow over the surface of the wall. Cast-in-place walls require a cast to be constructed in the right position and means to get the concrete slurry into the cast. This can be difficult to achieve in areas where access is limited.

Segmental retaining walls have been used widely for centuries. However, many wall constructions have traditionally required internal steel reinforcement. Corrosive expansion of the reinforcing steel or other metal could exceed the capacity of the block to contain the extra volume, weakening the blocks and the wall which they form. Also, traditional segmental retaining walls may allow water to pass through the wall only between the gaps in the blocks or not at all, creating hydrostatic pressure. Also, steel reinforcement can protrude from any grassed upper wall surface causing problems to motor mowers.

U.S. Pat. No. 5,865,006 (Dawson) discloses a concrete retaining wall block. However this is not of a permeable concrete.

OBJECT OF THE INVENTION

It is an object of the present invention to overcome or at least alleviate problems in wall constructions at the present and/or to overcome problems in segmental walls at the present by providing a new block or at least to provide the public with a useful choice.

SUMMARY OF THE INVENTION

According to one aspect of the present invention there is provided a block for use in construction of an inclined wall, said block including a top surface and a multiple level bottom surface wherein a forward level at the bottom surface is substantially parallel to the top surface and a rear level of the bottom surface is displaced further from the top surface than the forward level of the bottom surface so that a plurality of the blocks may be mounted one on top of the other in forming a stepped vertical face, said block being constructed from a permeable concrete having a permeability in the range of $10^{-2}$ to $10^{-4}$ m/s.

In one embodiment the permeability is about $6.00\times10^{-3}$ m/s.

Preferably, the block includes substantially vertical sides arranged so that the left and right extremities of the block are defined by a substantially vertical edge between two sides of the block.

Preferably, the forward and rear levels of the bottom surface are separated by a transitional surface substantially perpendicular to the forward level of the bottom surface.

Preferably, the block includes six sides, the front side defining a plane parallel to the transitional surface.

Preferably, the edges at the left and right extremities of the block are positioned closer to the front of the block than the rear by a certain extent.

Preferably, the edges at the left and right extremities of the block define a curved transition between the two sides of the block.

Preferably, the block includes lifting means on or near the top surface.

Preferably, the block is adapted to receive a decorative veneer on at least one side of the block.

Preferably, the block includes a veneer on the front side of the block.

According to another aspect of the present invention there is provided a block as substantially herein described and with reference to the accompanying drawings.

According to a further aspect of the present invention there is provided a method of constructing an inclined wall including stacking a plurality of blocks, each block being constructed of a permeable concrete having a permeability in the range of $10^{-2}$ to $10^{-4}$ m/s and including a top surface and a multiple level bottom surface wherein the forward level of the bottom surface is substantially parallel to the top surface and the rear level of the bottom surface is displaced further from the top surface than the forward level of the bottom surface, the top surface of the lower block being positionable so as to be accommodated by the top level of the bottom surface of a block immediately above.

In one embodiment the method uses concrete having a permeability of approximately $6.00\times10^{-3}$ m/s.

Preferably, the method includes orienting the blocks so that adjacent blocks only abut each other by an edge and a front surface of the block is parallel to the line of the wall.

Preferably, the method includes placing upper blocks so that they are centred at the transition between two blocks below it.

Preferably, the method includes providing blocks with a reduced distance between its front and rear faces and/or between side faces and placing them in the wall as required to facilitate a curve in the wall.

Preferably, the method includes providing blocks of reduced height along sections of the base and/or top surface of the wall.

Preferably, the method further includes placing a veneer over at least one side of the blocks.

According to a still further aspect of the present invention there is provided a method of constructing an inclined wall as substantially herein described by way of example and with reference to the accompanying drawings.

BRIEF DESCRIPTION OF PREFERRED EMBODIMENTS OF THE INVENTION

The use of concrete blocks in wall construction is well known. Concrete however has a permeability which can be classified as being very low or in fact practically impermeable, being typically less than $10^{-9}$ m/s. Typically concrete used in dam construction, for example, would have permeability of the order of between $8–28\times10^{-12}$ m/s.

Permeability, see for example "Soil Mechanics" by M. J. Smith, Second Edition 1970, published by McDonald & Evans, can be defined as the ease with which water can flow through material.

The flow of water through soils can be defined as:

$$\frac{Q}{t} = kA\frac{H}{l}$$

where Q=quantity of water flowing;
t=time for quantity Q to flow;
k=coefficient of permeability for the soil;
A=area of cross-section through which the water flows;
H=hydraulic head across soil;
l=length of flow path through soil.

The ratio H/l is known as the hydraulic gradient and is denoted as i. The coefficient of permeability k can therefore be given as:

$$\frac{Q/t}{Ai}$$

and can be defined as the rate of flow per unit area of soil, under unit hydraulic gradient. This coefficient k can be expressed as m/s and is equivalent to 3.281 ft/second.

In complete contrast, the concrete used in the present invention has a permeability which is about 1000 million times that of normal concrete.

To achieve this the present invention uses a mixture of coarse aggregates which are generally larger than 4.75 mm (3/16") with cement paste, the later being produced by mixing cement powder and water together. The present invention excludes the use of any fine aggregate which is normally used in concrete and accordingly while a slightly lower compressive strength has been achieved, what has been achieved also is a very much greater permeability.

In resting the concrete used in the present invention, three samples were tested and the following results were achieved:

| Sample | Head (mm) | Hydraulic Gradient (i) | Density (kg/m$^3$) | Permeability (m/s) |
|---|---|---|---|---|
| 1 | 70 | 0.46 | 2640 | $6.12 \times 10^{-3}$ |
| 2 | 70 | 0.46 | 2640 | $5.79 \times 10^{-3}$ |
| 3 | 70 | 0.47 | 2640 | $6.02 \times 10^{-3}$ |
| Average | | 0.46 | 2640 | $5.97 \times 10^{-3}$ |

It is seen therefore that three samples of concrete used in three possible embodiments of a block of the present invention have provided an average permeability of $5.97\times10^{-3}$ m/s.

A permeability however, in the range of $10^{-2}$ m/s to $10^{-4}$ m/s is considered to be suitable.

Figure 1:
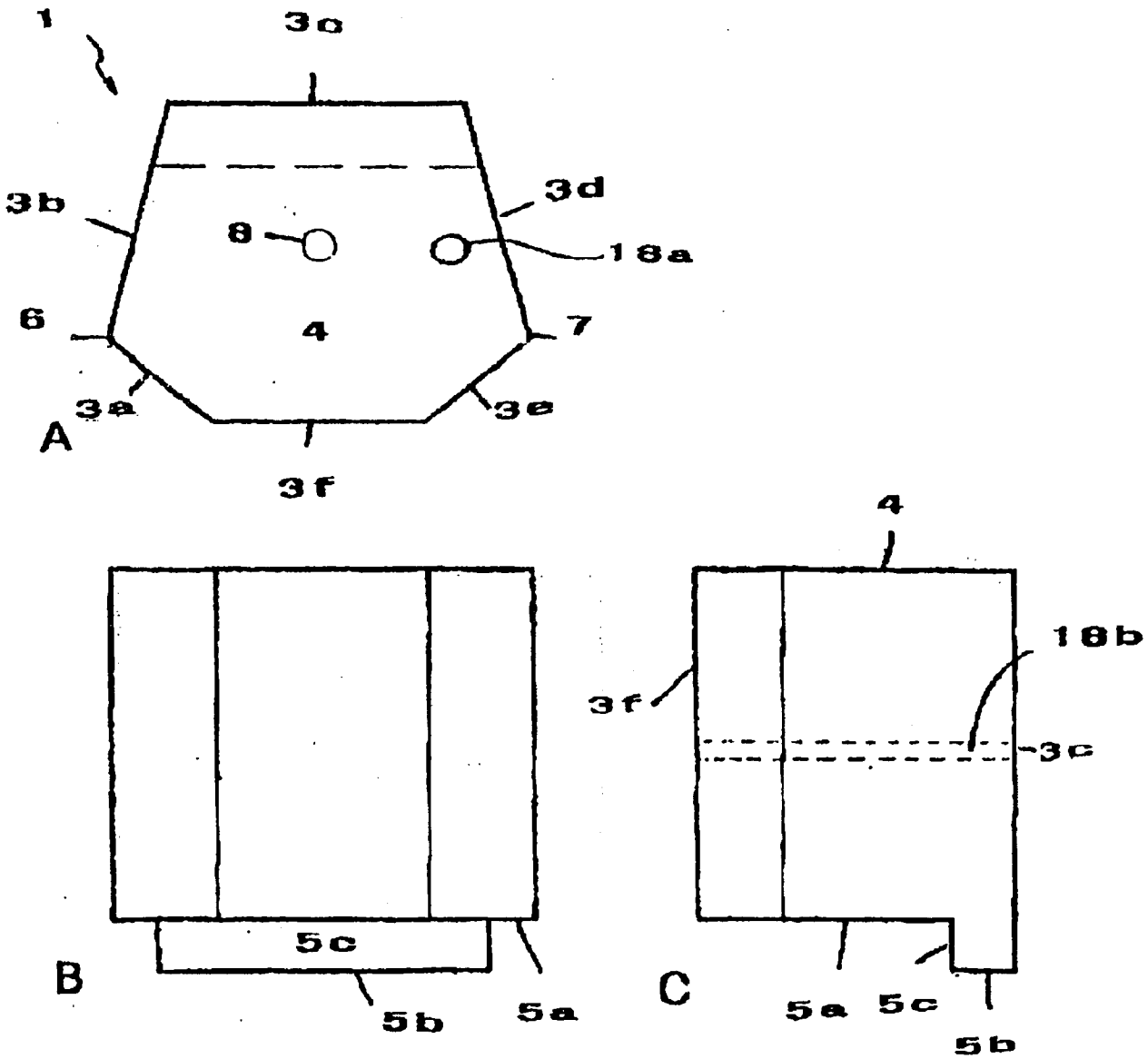
FIGS. 1A–C: show schematic representations of a plan, front and side view of the block respectively.

Referring now to FIG. 1A, a top view of one embodiment of the block 1 is shown. The block 1 may have six sides 3*a–f* and a lifting means 8 located on the top surface 4, preferably at the centre of gravity of the block 1. The lifting means may be a metal lug, rebar lifting device or any other appropriate device secured to the block 1.

Sides 3*a* and 3*b* of block 1 form an edge 6 which defines the left-most extremity of the block 1. Similarly sides 3*d* and 3*e* form an edge 7 at the right-most extremity. Therefore when two blocks 1 are placed adjacent to each other, they can relatively easily pivot about each other. This may give a wall constructed from blocks 1 three main advantages. The first is that a wall can be constructed having a curve or corner in it by pivoting adjacent blocks relative to each other. The second is that individual blocks 1 in a wall can move relative to each other, relieving large stresses and decreasing the chance of failure and/or increasing the life span of the wall. The third advantage of the edges 6 and 7 being at the side extremities of the block is that water can relatively easily travel between the blocks in this area, avoiding trapping water behind the wall. This avoids a hydrostatic pressure build-up that can shorten the life span of a wall. To provide further flow of water through the wall, the blocks are made from a permeable concrete having a permeability of at least $10^{-4}$ m/s, (equivalent to $3.281\times10^{-4}$ ft/sec) and may be of the order of $6.00\times10^{-3}$ m/s although it could be as high as $10^{-2}$ m/s.

The block 1 may be cast with one or more apertures 18*a* in, for example, its top surface 4 to receive guard rail posts or the like.

FIGS. 1B and 1C clearly show that the bottom surface 5 may have two levels with the forward level 5*a* being above the rear level 5*b*. The angle formed by the transition surface 5*c* between the two levels preferably matches the angle between the top surface 4 and side 3*c* and is preferably perpendicular, but may be angled or curved as appropriate. Blocks 1 can then be stacked on top of each other so that upper blocks are offset towards the rear of the lower blocks and the transition surface 5*c* between levels 5*a* and 5*b* prevents the upper blocks from sliding forwards. The height of the step or transition surface 5*c* an be of any required value and may vary with different blocks 1 used in the same retaining wall. Similarly, the size of the respective areas 5*a* and 5*b* can be varied as required.

In FIG. 1C, a through aperture 18*b* is shown extending between the front face 3*f* and the rear face 3*c*. This aperture 18*b* can be provided by casting the block around a metal or plastic tube for example. The aperture 18*b* can be used for tie backs, bolts, or the like to hold the blocks 1 in position.

Figure 2:
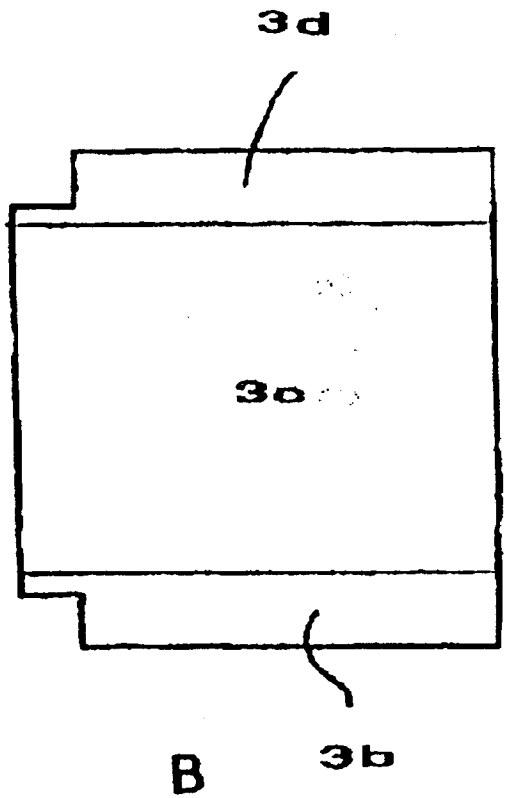
FIGS. 2A–B: show schematic representations of a bottom and rear view of the block respectively.
Figure 2:
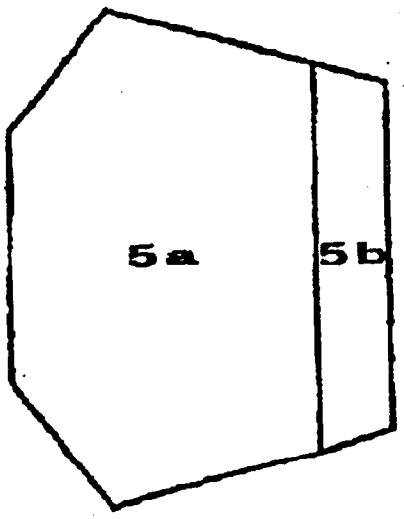

FIG. 2A shows a bottom view of a schematic representation of an example of a block 1 according to the present invention. Level 5*b* is shown to extend along about 20% of the surface 5. This may be varied to give a required offset between stacked upper and lower blocks 1 thereby obtaining a required inclination of a wall constructed by a plurality of blocks 1. FIG. 2B shows a rear view of block 1, on its side, showing a flat rear face 3*c* and the angled side faces 3*b* and 3*d*.

Figure 3:
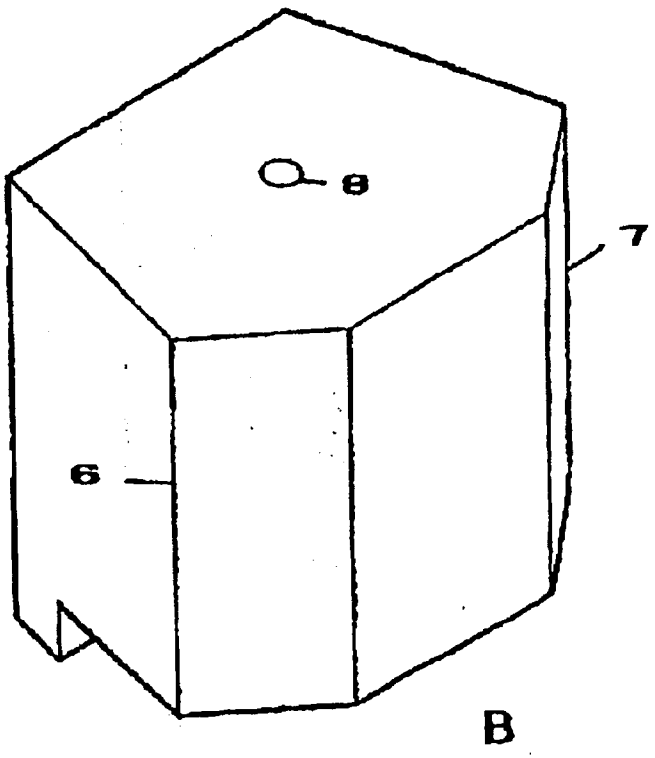
FIGS. 3A–B: show schematic representations of two perspective views of the block.
Figure 3:
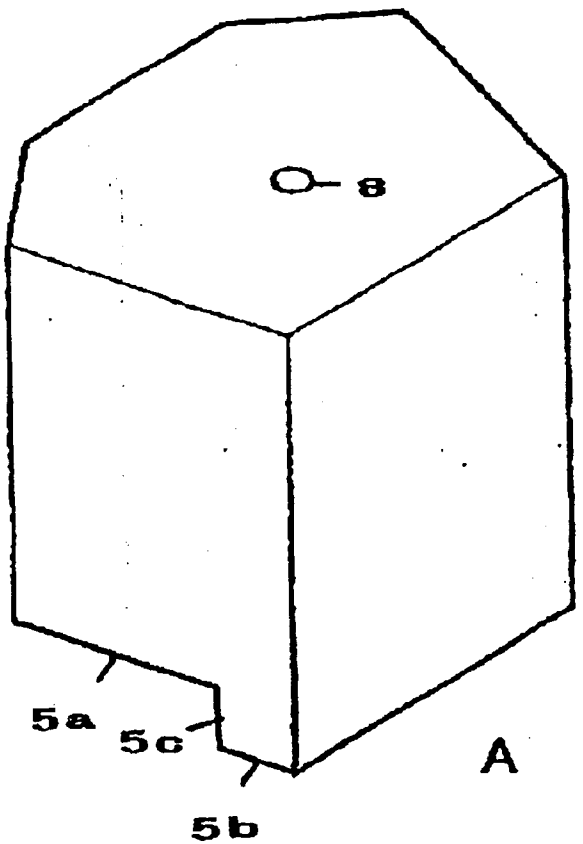

Now referring to FIGS. 3A and 3B, two perspective views of a block 1 are shown. Lifting means 8 may be positioned slightly towards the rear of the block 1 to keep it in the centre of gravity due to the extra weight at the rear caused by the split level surface 5.

Figure 4:
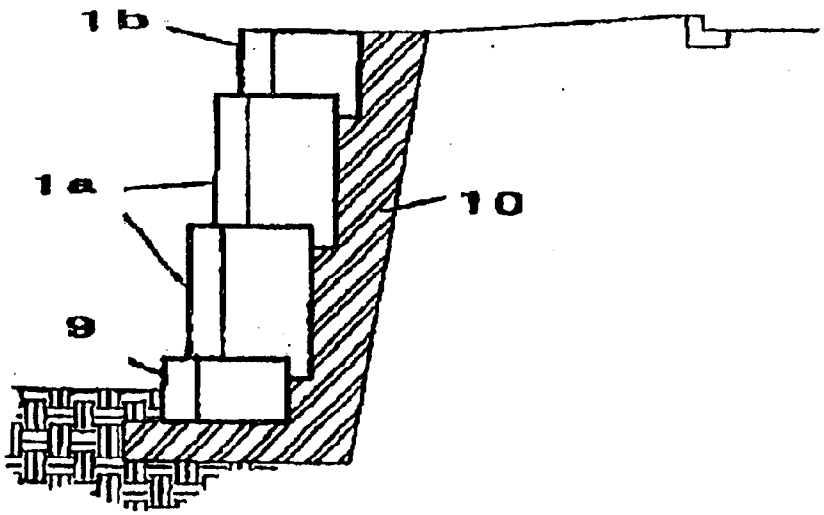
FIG. 4: shows a schematic representation of a side view of a retaining wall using one embodiment of the block in FIGS. 1–3.

FIG. 4 shows a schematic representation of a side view of a retaining wall constructed using a plurality of stacked blocks 1*a* and 1*b*. The base block 9 may have a single level bottom surface to avoid having to create a channel in the foundation material to accommodate the split bottom surface 5 of blocks 1. Preferably, the base block 9 has the same cross-section as blocks 1. In FIG. 4, it is shown of lesser height than the central blocks 1*a*.

The wall retains material 10 and the overhang created by the split level surface 5 of blocks 1 prevents upper blocks from sliding off lower blocks, this in combination with the surface-to-surface friction between the blocks 1. A gravity wall structure constructed from blocks 1 must form a coherent weight that has sufficient width to prevent both sliding at the base and overturning of the mass about the toe of the structure under the action of lateral earth forces. Further wall stabilisation means (not shown) may be included with the block 1, and may include the use of tie-back devices of a type known in the industry protruding from the blocks 1 into the material 10 to be retained. Geosynthetic reinforcement may also be used to stabilise a wall constructed from blocks 1.

Figure 5:
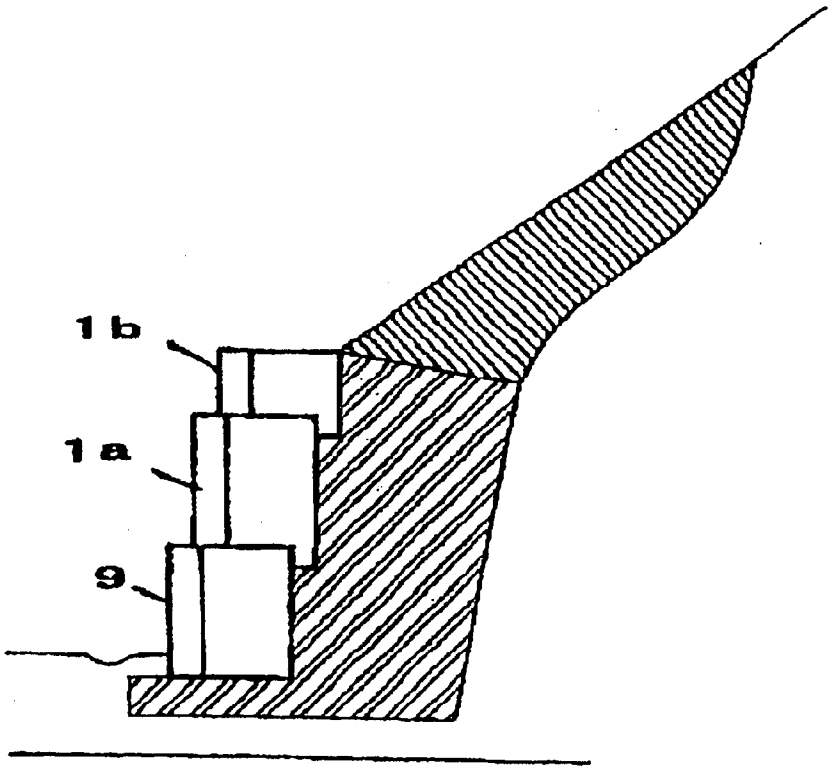
FIG. 5: shows a schematic representation of a side view of a second embodiment of a retaining wall.

FIG. 5 shows an alternative embodiment of a retaining wall constructed from blocks 1. In this embodiment base block 9 has a similar height to the central block 1*a*. Both FIGS. 4 and 5 show the use of variable height blocks 1 to result in a required height of the retaining wall.

Figure 6:
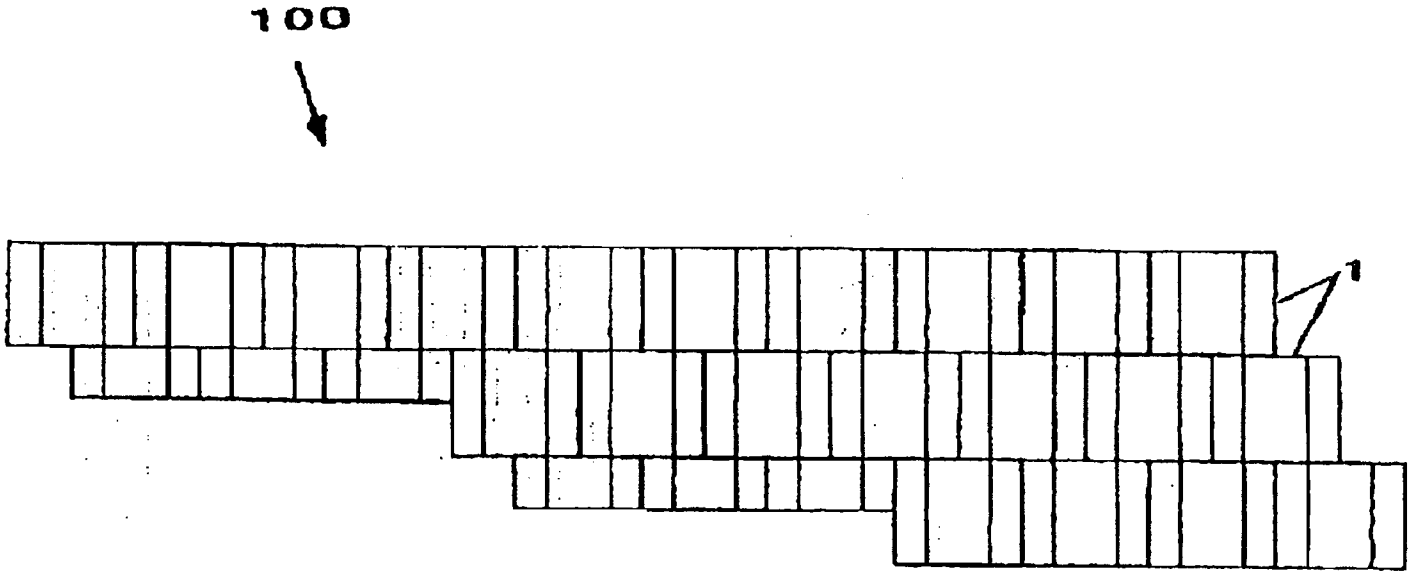
FIG. 6: shows a schematic representation of a front view of one embodiment of a retaining wall constructed on a sloped foundation material.

FIG. 6 shows a schematic representation of a front view of a retaining wall 100 according to the present invention. The blocks 1 in each vertical layer of the wall are shown to be centred on the gap between two blocks 1 in the layer above and below it. In the configuration shown in FIG. 6, blocks 1 of different height are used to allow placement of the wall over a variable sloping foundation. The wall has been configured so as to retain a level top surface.

Figure 7:
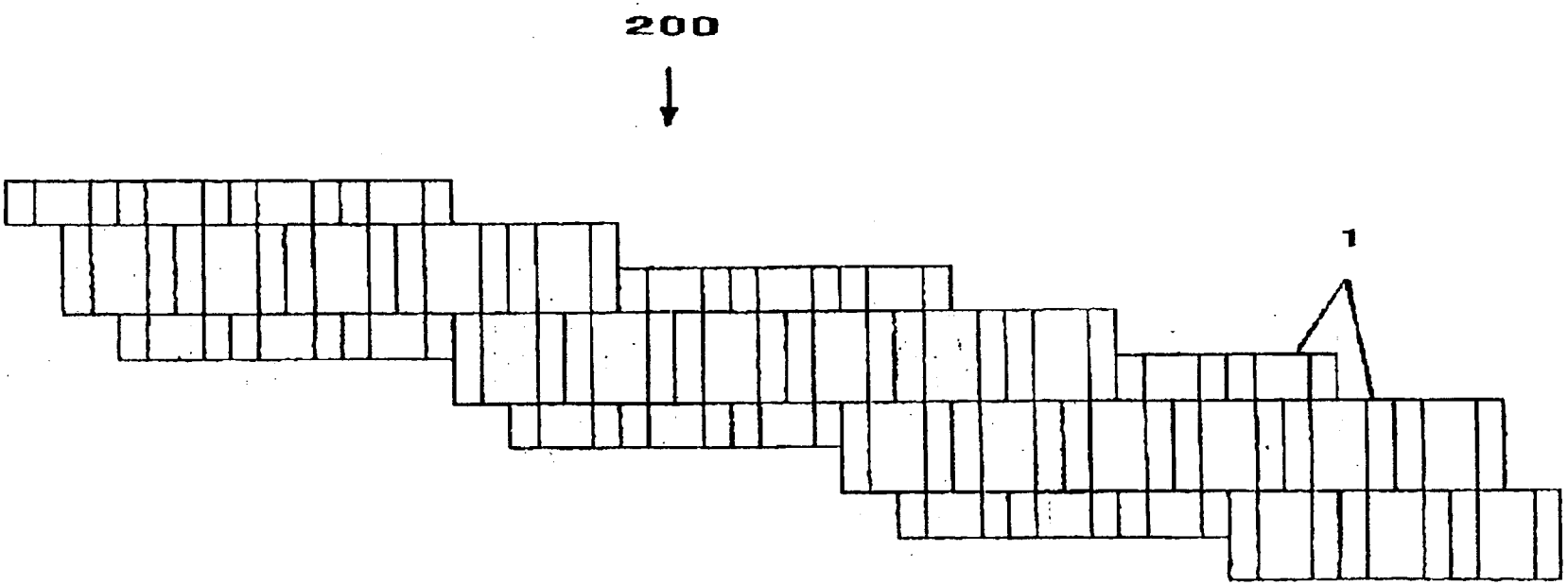
FIG. 7: shows a schematic representation of a front view of a second embodiment of a retaining wall constructed on a sloped foundation material.

FIG. 7 shows a schematic representation of a front view of a retaining wall 200 according to the present invention. In this embodiment the wall is stepped up both at its foundation and top surface. It will be appreciated that any configuration of blocks 1 of any number of heights could be used to create different wall profiles.

Figure 8:
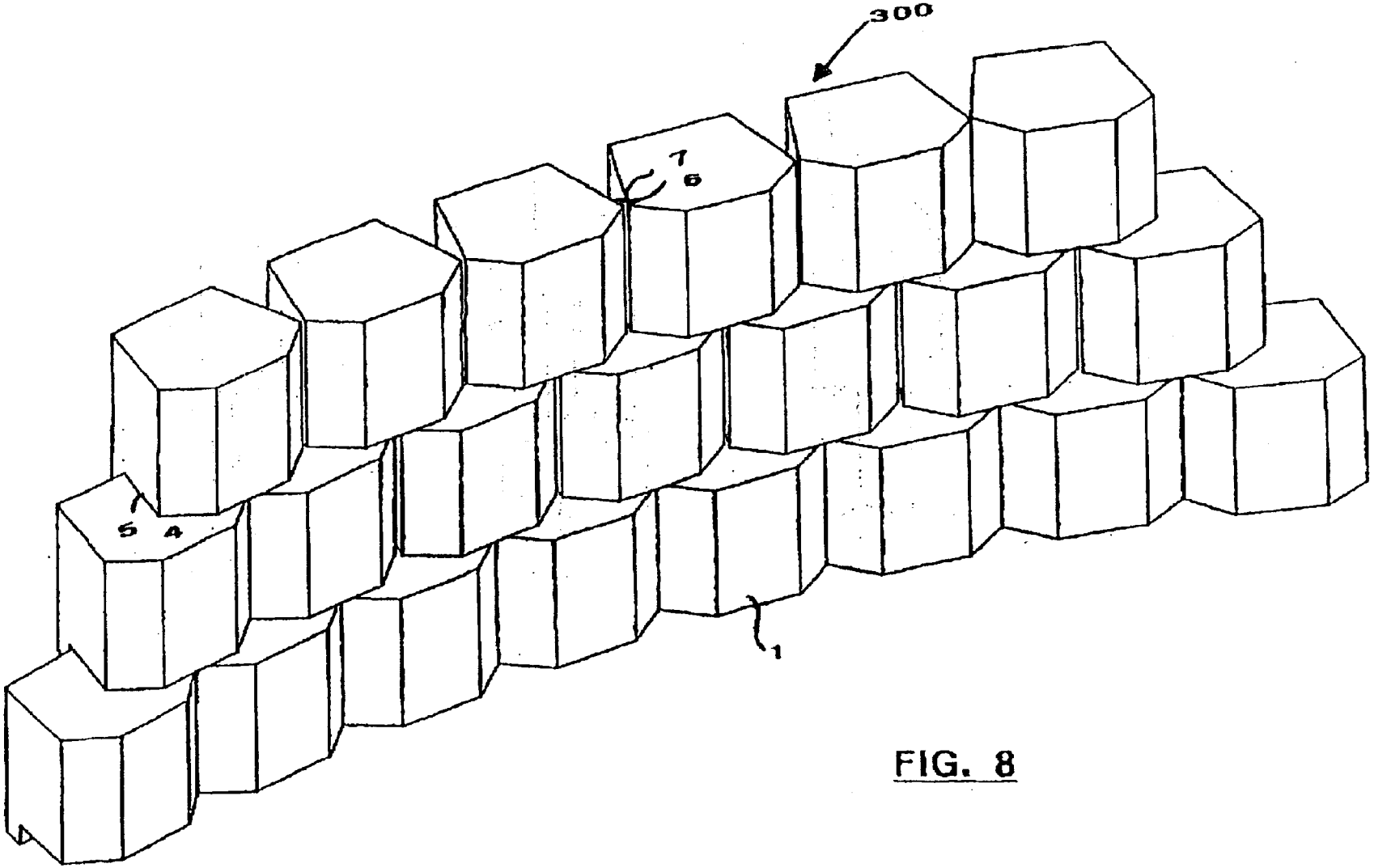
FIG. 8: shows a front schematic representation of a retaining wall constructed with a concave curve.

FIG. 8 shows a front view of a curved wall 300 with a concave curve in it constructed from blocks 1. The blocks 1 are placed in the wall, with edges 6 and 7 of each block abutting each other, the surface 5 of an upper block positioned on surface 4 of a lower block, and each layer displaced towards the rear of the layer below it to form an inclined wall. To allow the wall to retain uniform configuration on both sides of any substantial curve, a block of substantially the same shape as block 1 except with a shortened distance between its front and rear faces (3*c*, 3*f*) and/or its side faces (3*b*, 3*d*) may be used at the curved portion of the wall. The amount the block is shortened would be related to how sharp a curve in the wall is required.

Figure 9:
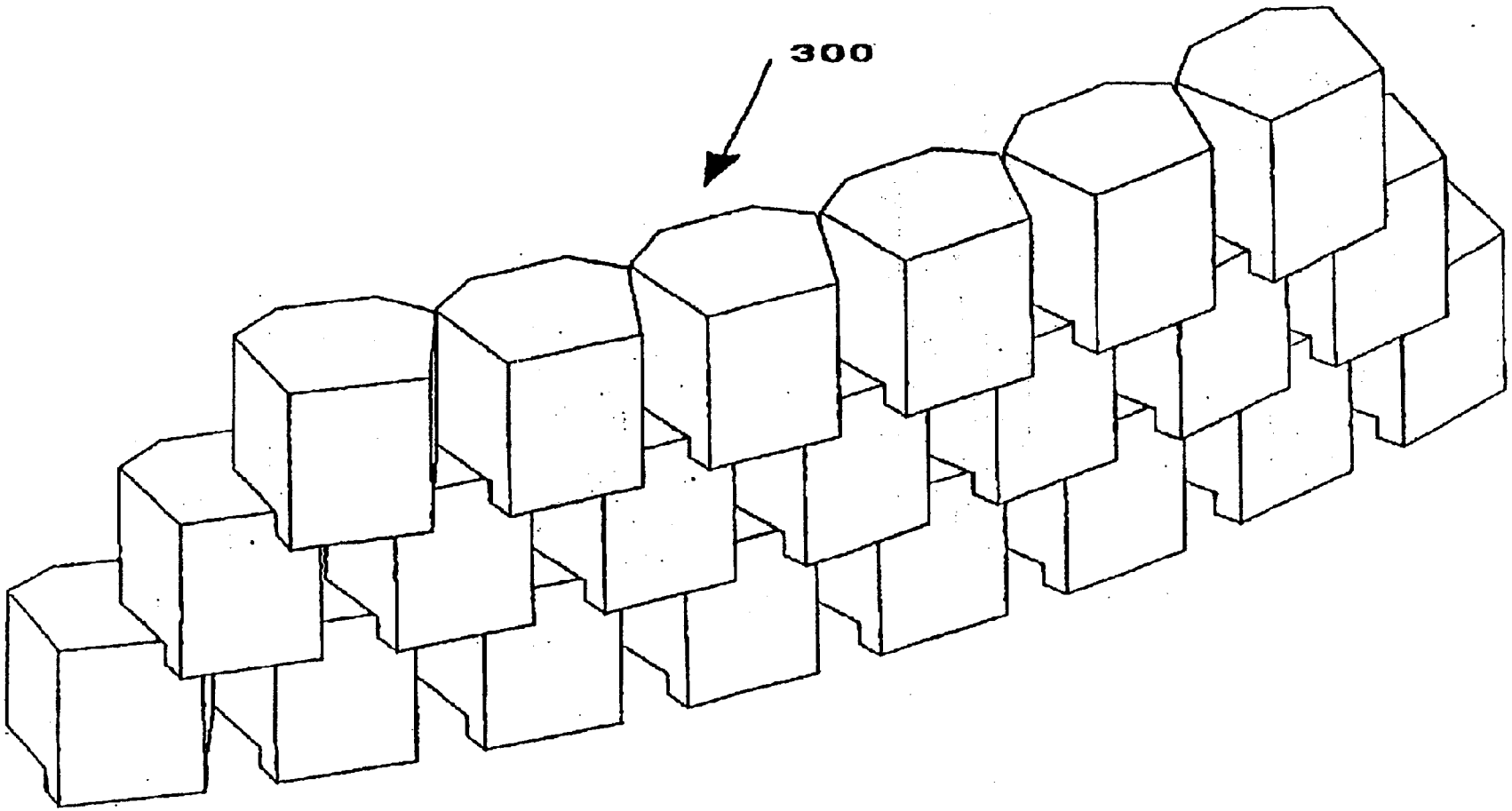
FIG. 9: shows a rear schematic representation of the retaining wall of FIG. 8.

FIG. 9 shows a rear view of the wall 300 of FIG. 8 with the concave curve in it constructed from the blocks.

A wall constructed from blocks 1 may support grass or other plants growing on its surfaces. This can improve the appearance of the wall and provides a further advantage over walls constructed from cast-in-place concrete or mortared timber. Additionally, the wall may include a decorative veneer on at least one surface to improve its appearance or come in a variety of colours.

It will be appreciated, that although the above examples have been given in reference to a retaining wall, the same principles may be applied in the construction of a coastal protection wall or any other similar wall.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

What is claimed is:

1. A block for use in construction of an inclined wall, said block including a top surface and a multiple level bottom surface wherein a forward level at the bottom surface is substantially parallel to the top surface and a rear level of the bottom surface is displaced further from the top surface than the front level of the bottom surface, so that a plurality of the blocks may be mounted one on top of the other in forming a stepped vertical wall, the block being constructed from a permeable concrete having a permeability in the range of $10^{-2}$ m/s to $10^{-4}$ m/s.

2. A block as claimed in claim 1 wherein the permeability is about $6.00\times10^{-3}$ m/s.

3. A block as claimed in claim 1, including substantially vertical sides arranged so that the left and right extremities of the block are each defined by a substantially vertical edge between two sides of the block.

4. A block as claimed in claim 3, wherein the edges at the left and right extremities of the block are positioned closer to the front of the block than the rear.

5. A block as claimed in claim 3 or claim 4, wherein the edges at the left and right extremities of the block define an angled transition between the two sides of the block.

6. A block as claimed in claim 1, wherein the forward and rear levels of the bottom surface are separated by a transitional surface substantially perpendicular to the forward level of the bottom surface.

7. A block as claimed in claim 6, including six sides, a front side defining a plane parallel to the transitional surface.

8. A method of constructing an inclined wall including stacking a plurality of blocks, each block being constructed of a permeable concrete having a permeability in the range of $10^{-2}$ m/s to $10^{-4}$ m/s and including a top surface and a multiple level bottom surface wherein the forward level of the bottom surface is substantially parallel to the top surface and the rear level of the bottom surface is displaced further from the top surface than the forward level of the bottom surface, the top surface of a lower block being positionable so as to be accommodated by the bottom surface of a block immediately above.

9. A method of constructing an inclined wall as claimed in claim 8, wherein the permeability is about $6.00\times10^{-3}$ m/s.

10. A method of constructing an inclined wall as claimed in claim 9, including providing blocks with a reduced distance between its front and rear faces and/or between its side faces and placing them in the wall as required to facilitate a curve in the wall.

* * * * *

UNITED STATES PATENT AND TRADEMARK OFFICE

CERTIFICATE OF CORRECTION

PATENT NO. : 6,877,290 B2
DATED : April 12, 2005
INVENTOR(S) : Brett Kerry Mason It is certified that error appears in the above-identified patent and that said Letters Patent is hereby corrected as shown below:

Title page,
Item [73], Assignee, should read -- Fletcher Building Holdings Limited, Auckland (NZ); Masstec Industries Limited, Auckland (NZ) --.

Signed and Sealed this

Nineteenth Day of July, 2005

JON W. DUDAS
*Director of the United States Patent and Trademark Office*